United States Patent [19]

Naugle

[11] 4,255,669

[45] Mar. 10, 1981

[54] SENSING APPARATUS

[75] Inventor: Richard L. Naugle, Framingham, Mass.

[73] Assignee: GTE Laboratories Incorporated, Waltham, Mass.

[21] Appl. No.: 75,782

[22] Filed: Sep. 17, 1979

[51] Int. Cl.[3] ..... G08B 21/00

[52] U.S. Cl. ..... 307/131; 307/358; 307/130; 361/87; 340/661; 340/664

[58] Field of Search ..... 307/126, 130, 131, 350, 307/358; 340/664, 654, 656, 660, 661; 361/86, 87

[56] References Cited

U.S. PATENT DOCUMENTS

| | | | |
|---|---|---|---|
| 3,249,929 | 5/1966 | Sillers | 307/358 X |
| 3,678,295 | 7/1972 | Heneghan | 307/350 |
| 3,789,236 | 1/1974 | Lacroix | 307/126 X |
| 3,958,212 | 5/1976 | Henthorne | 340/656 |
| 4,034,269 | 7/1977 | Wilkinson | 361/86 X |

*Primary Examiner*—L. T. Hix
*Assistant Examiner*—James L. Dwyer
*Attorney, Agent, or Firm*—David M. Keay

[57] ABSTRACT

Sensing apparatus for monitoring the operation of an electrical appliance. The sensing apparatus is plugged into a standard electrical outlet and the appliance to be monitored is plugged into the sensing apparatus. The appliance current flows through a transformer in the sensing apparatus. Detection circuitry including a comparator produces one signal when current flow through the transformer is negligible (appliance off) and another signal when the current flow through the transformer is significant (appliance on). Transistor circuitry connected to the detection circuitry produces a pulse at one output terminal on a transition from the one signal to the other signal from the detection circuitry (appliance turned on) and produces a pulse at another output terminal on a transition from the other signal to the one signal from the detection circuitry (appliance turned off).

8 Claims, 3 Drawing Figures

SENSING APPARATUS

BACKGROUND OF THE INVENTION

This invention relates to sensing apparatus. More particularly, it is concerned with sensing apparatus for monitoring the operation of electrical appliances.

In certain situations it is desirable to monitor the operation of electrical appliances. More specifically, it may be desirable to determine the presence or absence of activity within a dwelling unit by monitoring the turning off and/or turning on of one or more household appliances.

A system for passively monitoring the activities of certain persons, particularly elderly persons, is described in U.S. Pat. No. 3,885,235. This system monitors the occurrence of certain routine activities and provides appropriate indications in the event that such routine activities do not occur within a preselected period of time. The activities monitored include the operation of various electrical appliances such as radios, television sets, and other household appliances. Sensing apparatus are employed in conjunction with the selected appliances to note the operation of each appliance and in response to its operation to provide an indication for processing by the system.

SUMMARY OF THE INVENTION

The present invention provides an improved sensing apparatus for monitoring the operation of an electrical appliance. The apparatus employs electronic circuitry which is of extremely small size permitting unobtrusive mounting of the apparatus in close proximity to the electrical wall outlet supplying electrical power to the appliance being monitored.

Sensing apparatus in accordance with the present invention includes a transformer means having primary and secondary windings. Means are included for connecting the primary winding in the current path of an electrical appliance to be monitored. Detection circuit means which produces a first output condition when the current flow through the primary winding is less than a predetermined amount and produces a second output condition when the current flow through the primary winding is greater than the predetermined amount is coupled to the secondary winding of the transformer means.

A first transistor circuit means is coupled to the detection circuit means and operates in a first condition when the detection circuit means is producing the first output condition and operates in a second condition when the detection circuit means is producing the second output condition. A second transistor circuit means is coupled to the first transistor circuit means and produces an output signal at its output connection in response to the first transistor circuit means changing from the first condition to the second condition when the output condition of the detection circuit means changes from the first output condition to the second output condition. The first transistor circuit means produces an output signal at its output connection in response to changing from the second condition to the first condition when the output condition of the detection circuit means changes from the second output condition to the first output condition.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 1:
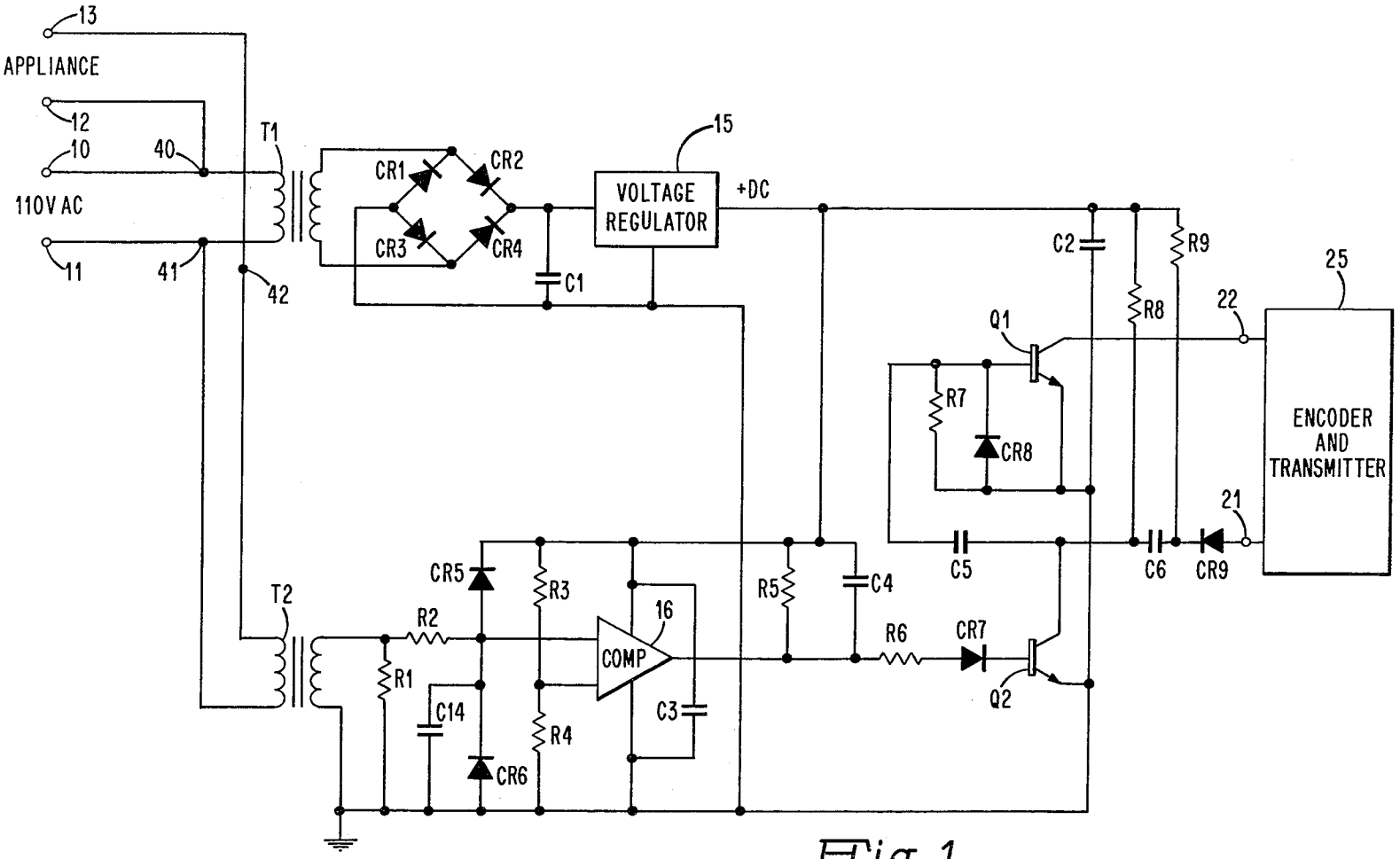
FIG. 1 is a schematic circuit diagram of sensing apparatus in accordance with the present invention.

FIG. 1 is a schematic circuit diagram of sensing apparatus in accordance with the present invention. The apparatus includes electrical connections 10 and 11 for connecting the apparatus to 110 volt AC household wiring. The apparatus also includes electrical connections 12 and 13 for connection to the AC male plug of an electrical appliance, the operation of which is to be monitored by the sensing apparatus. The AC electrical connection 10 is connected directly to the appliance connection 12 and to a terminal 40 which is connected to one end of the primary winding of a power supply transformer T1. (See FIG. 3.) The other AC electrical connection 11 is connected to a terminal 41 which is connected to the other end of the primary winding of transformer T1 and to one end of the primary winding of a current transformer T2. The other appliance connection 13 is connected to a terminal 42 which is connected to the other end of the primary winding of transformer T2. The primary winding of transformer T2 is, therefore, in the path of current flowing through the appliance. The primary winding of the transformer T2 is a single turn, for example, of 12 gauge wire.

A low voltage power supply for operating the apparatus includes the transformer T1 which has its primary winding connected across the AC line voltage connections 10 and 11. The secondary winding of the transformer is connected across a full-wave rectifier bridge of diodes CR1–CR4. The output of the bridge is connected to a filter capacitance C1 and a voltage regulator 15. In a particular embodiment the output of the voltage regulator 15 is +8 volts DC.

The secondary winding of the sensor input transformer T2 is connected to circuitry which detects whether the appliance is on or off. A sense resistance R1 is connected across the secondary winding and its value is selected so that the secondary voltage developed across it is proportional to the instantaneous current passing through the primary winding of the transformer T2. The secondary voltage developed across resistance R1 is coupled to one input of a comparator circuit 16 by resistance R2 and capacitance C14 which form high frequency filter to insure stable operation. Diodes CR5 and CR6 protect the input of the comparator from voltage surges. A reference voltage is applied to the second input of the comparator circuit 16 by a voltage divider consisting of resistances R3 and R4 connected between the DC voltage source and ground. The reference voltage produced provides a threshold voltage at the second input which must be exceeded by the voltage at the first input in order to drive the comparator. In one specific embodiment the threshold voltage is set at 100 millivolts which is exceeded when the appliance draws a sustained peak current of about 100 milliamperes. A network of a parallel resistance R5 and a capacitance C4 is connected between the positive voltage source and the comparator output.

The output of the comparator circuit 16 is coupled to the base of a first bipolar NPN transistor Q2 by a resistance R6 and a diode CR7. The emitter of transistor Q2 is connected directly to ground and the collector is connected through a resistance R8 to the positive voltage supply. The collector is also connected by way of a capacitance C6 and a diode CR9 to an output terminal 21. The juncture between capacitance C6 and diode CR9 is connected to the positive voltage source through a resistance R9.

The collector of the first transistor Q2 is also connected by way of a capacitance C5 to the base of a second NPN bipolar transistor Q1. A resistance R7 and a diode CR8 are connected between the base and emitter of transistor Q1 and the emitter is connected to ground. The collector of transistor Q1 is connected to an output terminal 22. Both output terminals 21 and 22 are connected as inputs to an encoder and transmitter 25 which transmits a suitably encoded RF signal indicating the change in operating state of the appliance being monitored as will be explained hereinbelow. Suitable paths to ground for the output terminals 21 and 22 are provided within the encoder and transmitter. One form of an encoder and transmitter suitable for use with the sensing apparatus of the present invention is described in greater detail in application Ser. no. 075,783 filed Sept 17, 1979 concurrently herewith by Jeffrey R. Fox, Arthur Margolies, and Rob Moolenbeek entitled "Electrical Power Supply Apparatus" and assigned to the assignee of the present application.

When the sensing apparatus is connected to 110 volt AC supply and a suitable appliance is connected to connections 12 and 13 with the appliance off, no current flows through the primary winding of the sensor input transformer T2. Under these conditions the input circuitry to the comparator circuit 16 produces a voltage at its first input which is less than the reference voltage at its second input causing the output of the comparator circuit 16 to be relatively high, or at logic 1. Capacitance C4 is in a discharged condition and base current is supplied to transistor Q2 causing that transistor to conduct. The collector of transistor Q2 is low biaing transistor Q1 in a nonconducting condition.

When the appliance is turned on, the current flowing through the appliance also flows through the primary winding of transformer T2. A secondary voltage is developed across sense resistance R1 which is proportional to the instantaneous current flowing through the primary winding. This voltage is an alternating voltage. When the positive peaks of the alternating voltage appliance to the first input of the comparator 16 are greater than the threshold voltage at the second input, the comparator is turned on. The output stage of the comparator circuit 16 is a so-called open collector transistor which when conducting provides essentially a direct path between the comparator output and ground, producing a logic 0 at the output. During each positive peak with the output of the comparator near ground potential, the capacitance C4 is rapidly charged to the DC supply voltage. In each period between positive peaks when the comparator circuit 16 is off and does not present a short circuit between its output and ground, the voltage at the output tends to rise. In order for the voltage at the output to rise, capacitance C4 must discharge. Since the only discharge path for capacitance C4 is through resistance R5, a combination which has a fairly long time constant, the voltage at the comparator output rises very slowly. The voltage at the output thus remains sufficiently low so as to continuously provide a logic 0 for as long as the current through the appliance is sufficient to produce positive peaks at the first input to the comparator 16 which are greater than the threshold voltage.

With the output of the comparator 16 at logic 0 the source of base current drive for transistor Q2 is removed and that transistor becomes nonconducting. As current flow through the collector of transistor Q2 is reduced, the voltage at the collector rises. This positive transition is coupled to the base of transistor Q1 by way of the differentiation action of capacitance C5 and resistance R7. Transistor Q1 conducts causing its collector and the output terminal 22 connected thereto to go low. Thus the turning off of transistor Q2 momentarily biases transistor Q1 to conduction producing a negative-going pulse at the output terminal 22. This pulse is an indication that the appliance being monitored has been turned from off to on and may be utilized by the encoder and transmitter 25 to transmit a message or signal to this effect.

When the appliance attached to the sensor is turned off, the secondary voltage across the sense resistance R1 is reduced and the comparator circuit 16 is turned off. The voltage at the comparator output increases as capacitance C4 discharges through resistance R5. Base current is provided to transistor Q2 causing that transistor to conduct. The voltage at the collector of transistor Q2 decreases and the negative-going transition is coupled by way of capacitance C6 and diode CR9 to output terminal 21. A momentary negative-going pulse appears at the output terminal 21 and is applied to the encoder and transmitter 25 for transmission of a message or signal indicating that the appliance has been switched off.

Figure 2:
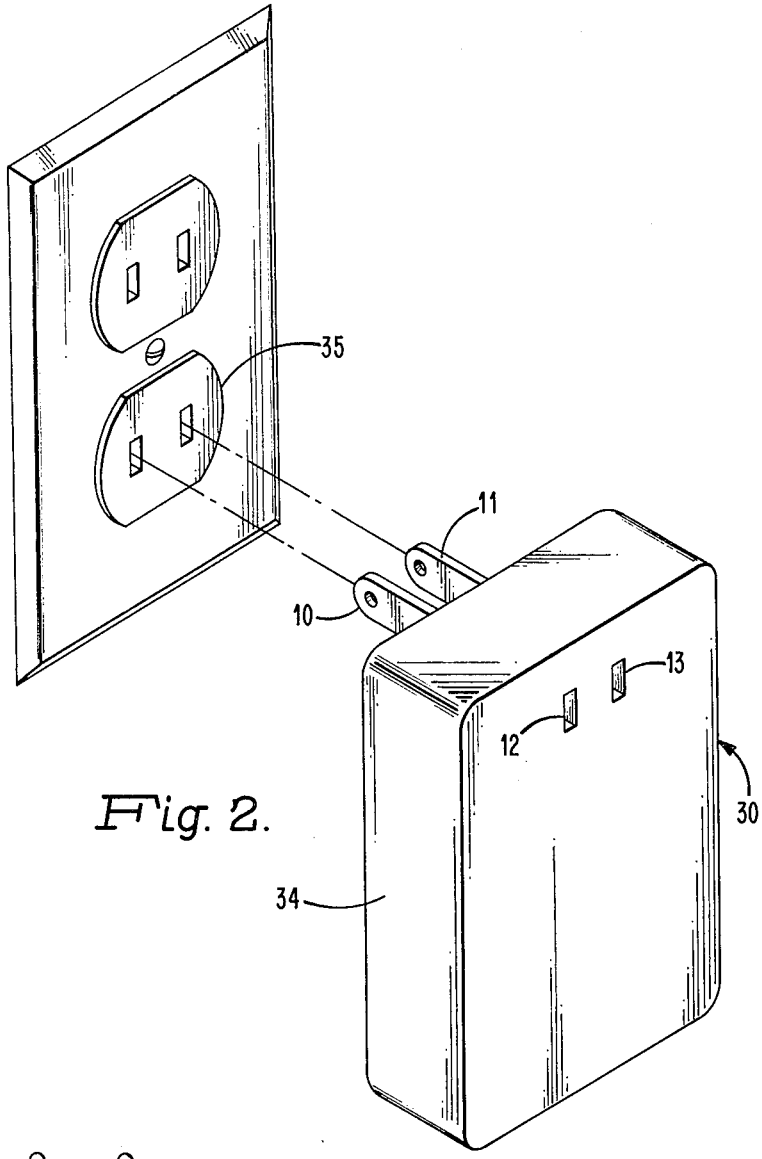
FIG. 2 is a perspective view of sensing apparatus in accordance with the present invention.
Figure 3:
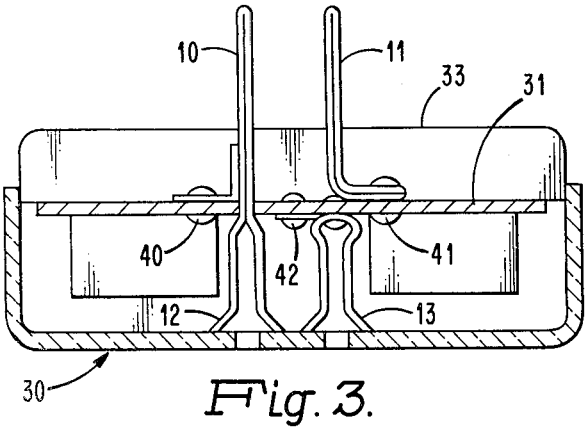
FIG. 3 is a top view partially in cross-section showing certain details of the sensing apparatus of FIG. 2.

FIGS. 2 and 3 illustrate the sensing apparatus with the elements of the circuit shown in the schematic diagram of FIG. 1 mounted and enclosed to provide a single enclosed unit 30. The circuit elements are suitably mounted on a circuit board 31. The circuit board 31 is mounted on a base member 33 and a cover 34 completes the enclosure. Electrical contact members for making electrical connection to a 110 volt AC line and to an appliance are also mounted on the circuit board 31. AC connections 10 and 11 are standard male contact members which are fixedly mounted with respect to each other and extend outwardly from the enclosure so as to permit insertion into a standard 110 volt electrical outlet 35. Appliance connections 12 and 13 are female contact members arranged and adapted to receive the contact members of a standard AC male plug as commonly supplied with appliances of the type to be monitored. Access to the female contact members is provided by slots in the cover 34.

One male contact member 10 is connected directly to one of the female contact members 12 and to the terminal 40. Terminal 40 is connected to one end of the primary winding of the power supply transformer T1. The other male contact member 11 is electrically isolated from the other female contact member 13. The male contact member 11 is connected to the terminal 41 which is connected to the other end of the primary winding of transformer T1 and also to one end of the primary winding of the sensor input transformer T2. The female contact member 13 is connected to the terminal 42 which is connected to the other end of the primary winding of the transformer T2.

Since the electrical components of the sensor are small and may include integrated circuitry, the enclosed unit 30 with the male and female contact members mounted as shown is a small unobtrusive device which readily may be plugged into a single electrical outlet and in turn receive the plug of an appliance. Thus, passive monitoring of any selected appliance operating from any selected electrical outlet is readily obtained without changes or alterations in the wiring or in the appliance and without reducing the number of electrical outlets available.

While there has been shown and described what is considered a preferred embodiment of the present invention, it will be obvious to those skilled in the art that various changes and modifications may be made therein without departing from the invention as defined by the appended claims.

What is claimed is:

1. Sensing apparatus for monitoring the operation of an electrical appliance including in combination transformer means having a primary winding and a secondary winding;

means for connecting the primary winding of the transformer means in the current path of an electrical appliance to be monitored;

detection circuit means coupled to the secondary winding of the transformer means, the detection circuit means being operable to produce a first output condition when the current flow through the primary winding of the transformer means is less than a predetermined amount and to produce a second output condition when the current flow through the primary winding of the transformer means is greater than said predetermined amount;

first transistor circuit means coupled to said detection circuit means and having an output connection, said first transistor circuit means being operable in a first condition when the detection circuit means is producing a first output condition and in a second conditiion when the detection circuit means is producing a second output condition; and second transistor circuit means coupled to said first transistor circuit means and having an output connection, said second transistor circuit means being operable to produce an output signal at its output connection in response to the first transistor circuit means changing from said first condition to said second condition when the output condition of the detection circuit means changes from the first output condition to the second output condition, and said second transistor circuit means producing no output signal at its output connection in response to the first transistor circuit means changing from said second condition to said first condition when the output condition of the detection circuit means changes from the second output condition to the first output condition;

said first transistor circuit means being operable to produce an output signal at its output connection in response to changing from the second condition to the first condition when the output condition of the detection circuit means changes from the second output condition to the first output condition, said first transistor circuit means producing no output signal at its output connection in response to changing from the first condition to the second condition when the output condition of the detection circuit means changes from the first output condition to the second output condition.

2. Sensing apparatus in accordance with claim 1 including a source of potential;

and wherein said first transistor circuit means includes a first transistor having an input electrode coupled to the detection circuit means and having an output electrode coupled to the source of potential and to the output connection of the first transistor circuit means;

said first transistor being biased in a conducting condition when the detection circuit means is producing a first output condition, and being biased in a nonconducting condition when the detection circuit means is producing a second output condition;

said second transistor circuit means includes a second transistor having an output electrode coupled to the output connection of the second transistor circuit means and having an input electrode; and said second transistor circuit means includes circuit means coupling the output electrode of the first transistor to the input electrode of the second transistor, said circuit means normally biasing the second transistor to nonconduction and momentarily biasing the second transistor to conduction in response to the first transistor changing from the conducting to the nonconducting condition.

3. Sensing apparatus in accordance with claim 2 wherein said first transistor circuit means includes means connecting the output electrode of the first transistor to the output connection of the first transistor circuit means for producing an output pulse at the output connection in response to the first transistor changing from the nonconducting to the conducting condition, said means being operable not to respond to the first transistor changing from the conducting to the nonconducting condition whereby no output pulse is produced at the output connection in response to the first transistor changing from the conducting to the nonconducting condition; and said second transistor circuit means includes means connecting the output electrode of the second transistor to the output connection of the second transistor circuit means for producing an output pulse at the output connection when the second transistor is momentarily biased to conduction.

4. Sensing apparatus in accordance with claim 1 wherein said detection circuit means includes comparator circuit means having an input connection and having an output connection coupled to the first transistor circuit means;

charge storage means coupled to the output connection of the comparator circuit means;

input circuit means coupled to the secondary winding of the transformer means and to the input connection of the comparator circuit means and operable to produce an AC voltage signal at the input connection proportional to current flow through the primary winding of the transformer means;

said comparator circuit means being operable to produce a constant first voltage at its output connection when the peaks of the AC voltage signal at its input connection are less than a predetermined level;

said comparator circuit means being operable to produce a second voltage at its output connection during the peaks of the AC voltage signal at its input connection which are greater than said predetermined level;

said charge storage means being operable to discharge rapidly when the second voltage is produced at the output connection of the comparator circuit means during the peaks of an AC voltage signal at its input connection;

said charge storage means being operable to charge slowly when the second voltage is not being produced at the output connection whereby the voltage at the output connection of the comparator circuit means remains at approximately said second voltage when an AC voltage signal having peaks greater than said predetermined level is present at the input connection of the comparator circuit means.

5. Sensing apparatus in accordance with claim 4 including a source of potential;

and wherein said charge storage means includes a resistance and a capacitance connected between said source of potential and the output connection of the comparator circuit means; and said comparator circuit means includes threshold setting means for establishing said predetermined voltage level below which the comparator circuit means produces said first voltage at its output connection and above which the comparator circuit means together with the charge storage means produces said second voltage at its output connection.

6. Sensing apparatus in accordance with claim 4 including a source of potential;

and wherein said first transistor circuit means includes a first transistor having an input electrode coupled to the output connection of the comparator circuit means and having an output electrode coupled to the source of potential and to the output connection of the first transistor circuit means;

said first transistor being biased in a conducting condition when said first voltage is present at the output connection of the comparator circuit means, and being biased in a nonconducting condition when said second voltage is present at the output connection of the comparator circuit means;

said second transistor circuit means includes a second transistor having an output electrode coupled to the the output connection of the second transistor circuit means and having an input electrode; and said second transistor circuit means includes circuit means coupling the output electrode of the first transistor to the input electrode of the second transistor, said circuit means normally biasing the second transistor to nonconduction and momentarily biasing the second transistor to conduction in response to the first transistor changing from the conducting to the nonconducting condition.

7. Sensing apparatus in accordance with claim 6 wherein said charge storage means includes a resistance and a capacitance connected between said source of potential and the output connection of the comparator circuit means;

said comparator circuit means includes threshold setting means for establishing said predetermined voltage level below which the comparator circuit means produces said first voltage at its output connection and above which the comparator circuit means together with the charge storage means produces said second voltage at its output connection;

said first transistor circuit means includes means connecting the output electrode of the first transistor to the output connection of the first transistor circuit means for producing an output pulse at the output connection in response to the first transistor changing from the nonconducting to the conducting condition, said means being operable not to respond to the first transistor changing from the conducting to the nonconducting condition whereby no output pulse is produced at the output connection in response to the first transistor changing from the conducting to the nonconducting condition; and said second transistor circuit means includes means connecting the output electrode of the second transistor to the output connection of the second transistor circuit means for producing an output pulse at the output connection when the second transistor is momentarily biased to conduction.

8. Sensing apparatus in accordance with claim 1 or 7 wherein the means for connecting the primary winding of the transformer means in the current path of an electrical appliance to be monitored includes an electrical receptacle adapted to receive the male AC plug of an electrical appliance;

the electrical receptacle having a pair of female contact members for making electrical connection to the male contact members of an AC plug;

a pair of male contact members fixedly mounted with respect to the electrical receptacle and adapted to be plugged into an electrical outlet;

one of said pair of male contact members being connected directly to one of said pair of female contact members; and the other of said pair of male contact members being connected to the other of said pair of female contact members through the primary winding of the transformer means whereby current flowing through the appliance flows through the primary winding of the transformer means.

* * * * *